US006729982B1

(12) United States Patent
Appelbaum et al.

(10) Patent No.: US 6,729,982 B1
(45) **Date of Patent: *May 4, 2004**

(54) TABLE TENNIS TABLE, CONVERSION KIT AND ASSOCIATED METHOD

(75) Inventors: Richard Appelbaum, New York, NY (US); Peter J. Wilk, New York, NY (US)

(73) Assignee: Wilk Patent Development Corp., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/447,071

(22) Filed: Nov. 22, 1999

Related U.S. Application Data

(60) Provisional application No. 60/109,499, filed on Nov. 23, 1998.

(51) Int. Cl.[7] ..... A63B 67/04; A63B 71/04

(52) U.S. Cl. ..... 473/496; 473/14; 108/59; 108/11; 108/90; 273/309

(58) Field of Search ..... 271/108, 108.1, 271/309; 473/4, 9, 10, 496, 490, 491, FOR 112, FOR 113, FOR 171, FOR 174, 434, 435, 465, 473, 474, 475; 108/64, 69, 90, 70, 77, 78; D6/430, 480

(56) References Cited

U.S. PATENT DOCUMENTS

| | | | | |
|---|---|---|---|---|
| 2,127,873 A | | 8/1938 | Guillou | |
| 2,367,948 A | * | 1/1945 | Kirsch | 108/90 |
| 2,643,924 A | * | 6/1953 | Albano | 108/77 |
| 2,955,888 A | * | 10/1960 | Graves | 108/69 |
| 3,088,735 A | * | 5/1963 | Clark | 473/434 |
| 3,814,422 A | * | 6/1974 | Girden | 473/435 |
| 4,030,734 A | | 6/1977 | Castellucci | |
| 4,176,842 A | | 12/1979 | Zaldivar | |
| D260,154 S | | 8/1981 | Dremel | |
| 4,446,796 A | | 5/1984 | Wilson et al. | |
| 4,750,432 A | * | 6/1988 | McNamara et al. | 108/78 |
| 4,765,619 A | * | 8/1988 | Cooper | 473/496 |
| 4,850,590 A | | 7/1989 | Lin | |
| 4,943,056 A | * | 7/1990 | Bowers | 473/434 |
| 4,969,645 A | | 11/1990 | Barbador | |
| 5,178,385 A | | 1/1993 | Barbador | |
| 5,354,051 A | * | 10/1994 | Fehrenbach et al. | 473/434 |
| 5,375,837 A | | 12/1994 | Moreau | |
| 5,460,365 A | | 10/1995 | Payne | |
| 5,575,471 A | | 11/1996 | Robinson et al. | |
| D385,728 S | * | 11/1997 | Mulligan et al. | D6/480 |
| 5,833,559 A | * | 11/1998 | Appelbaum et al. | 473/496 |

FOREIGN PATENT DOCUMENTS

| | | |
|---|---|---|
| FR | 2579-899 A | 4/1985 |
| GB | 231967 | 4/1925 |

OTHER PUBLICATIONS

U.S. Tennis Association—The Rules of Tennis (The Doubles Game).*

Paddle Tennis: Official Rules of Play, by U.S. Paddle Tennis Association, 1996.*

* cited by examiner

*Primary Examiner*—Gregory Vidovich
*Assistant Examiner*—Mitra Aryanpour
(74) *Attorney, Agent, or Firm*—R. Neil Sudol; Henry D. Coleman; William J. Sapone

(57) ABSTRACT

A table tennis table has a main panel defining a playing surface and a pair of opposing edges. A frame is connected to the playing surface for supporting the playing surface in a horizontal orientation, a pair of substantially rigid auxiliary panels, and adjustable mounting elements mounting the auxiliary panels to the frame along respective ones of the edges so that the auxiliary panels each have a first orientation extending substantially perpendicularly relative to the main panel and an alternate second orientation substantially coplanar with the main panel to extend the playing surface of the main panel. A table tennis net is connected perpendicular to the playing surface and extends transversely along a midline thereof.

33 Claims, 7 Drawing Sheets

TABLE TENNIS TABLE, CONVERSION KIT AND ASSOCIATED METHOD

CROSS-REFERENCE TO A RELATED APPLICATION

This application relies for priority purposes on U.S. provisional application No. 60/109,499 filed Nov. 23, 1998.

BACKGROUND OF THE INVENTION

This invention relates to a table tennis table. More particularly, this invention relates to a table tennis table capable of conversion to different forms to enable the playing of different table tennis games. This invention also relates to a kit for converting a table tennis table to enable the playing of different kinds of table tennis games. This invention additionally relates to a method for modifying a table tennis table to assume different forms for accommodating the playing of different table tennis type games.

Table tennis has long been popular in the game rooms of America and across the world, offering recreation for novice players and intense competition among the finest. The game, however, is limited in that only two players can participate at a time, and frequent interruptions in play result when a ball is bounced out of bounds and off the table. Furthermore, there is a natural desire to seek variety in recreation, whereas the standard table tennis table is useful only for the traditional game of table tennis.

OBJECTS OF THE INVENTION

It is an object of the present invention to provide a table tennis table.

More specifically, it is an object of the present invention to provide a table tennis table capable of selectively accommodating alternative games.

It is an additional object of the present invention to provide a retrofit assembly for use with standard table tennis tables, capable of selectively accommodating alternative games.

It is a further object of the present invention to provide a method of modifying a table tennis table to selectively accommodate alternative games.

Yet another object of the present invention is to provide a method of playing a table tennis game.

These and other objects of the invention will be apparent from the drawings and descriptions herein.

SUMMARY OF THE INVENTION

A table tennis table comprises, in accordance with the present invention, a main panel defining a playing surface and having a pair of opposing edges, a frame connected to the playing surface for supporting the playing surface in a horizontal orientation, a pair of substantially rigid auxiliary panels, and adjustable mounting elements mounting the auxiliary panels to the frame along respective ones of the edges so that the auxiliary panels each have a first orientation extending substantially perpendicularly relative to the main panel and an alternate second orientation substantially coplanar with the main panel to extend the playing surface of the main panel. A table tennis net is connected perpendicular to the playing surface and extends transversely along a midline thereof.

Where the opposing edges are major edges of the main panel and extend parallel to a length dimension of the main panel, the auxiliary panels serve to laterally extend the playing surface when the auxiliary panels are disposed in the second orientation. In this case, the net can be adjusted to a first effective length to extend only across the playing surface when the auxiliary panels are in the first orientation and to a second effective length to extend across the playing surface and the auxiliary panels when the auxiliary panels are in the second orientation. Means are connected to the net for maintaining the net at the first effective length and alternately at the second effective length.

In accordance with another feature of the present invention, the adjustable mounting elements include means for mounting the auxiliary panels to the frame along respective ones of the edges so that the auxiliary panels have a third orientation extending substantially perpendicularly relative to the main panel and upwardly from the main panel. A bracket may be connected to the frame for attaching the auxiliary panels alternately in the second orientation and the third orientation. The bracket may include a pair of legs of different effective lengths, one length for supporting the auxiliary panels in the second orientation and another length in combination with the one length for supporting the auxiliary panels in the third orientation.

In accordance with a supplementary or alternative feature of the present invention, the adjustable mounting elements include a plurality of brackets each connected at one end thereof to the frame and at an opposite end thereof to one of the auxiliary panels. The brackets may each take the form of a slidable linkage. In that case, the adjustable mounting elements further include tension cords each extending between the frame and the linkage for drawing the linkage toward the frame.

Where the playing surface is provided with a downwardly depending skirt, the adjustable mounting elements may include a plurality of brackets removably connected to the skirt, the adjustable mounting elements further including means on the auxiliary panels for cooperating with the brackets to support the auxiliary panels on the brackets. The brackets each preferably includes an L-shaped portion, the means for cooperating being notches.

In accordance with another alternative feature of the present invention, the adjustable mounting elements include a plurality of double acting hinges each connected to the main panel and one of the auxiliary panels.

A kit in accordance with the present invention is provided for modifying a table tennis table including a main panel defining a playing surface and having a pair of opposing edges, the table further including a frame connected to the playing surface for supporting the playing surface in a horizontal orientation. The kit comprises a pair of substantially rigid auxiliary panels, adjustable mounting elements for attaching the auxiliary panels to the frame along respective ones of the opposing edges of the main panel so that the auxiliary panels have a first orientation extending substantially perpendicular to the playing surface and an alternate second orientation substantially coplanar with the playing surface to extend the playing surface. A net is connectable perpendicular to the playing surface and extends transversely along a midline thereof.

Where the opposing edges are major edges of the main panel and extend parallel to a length dimension of the main panel, the auxiliary panels serve to laterally extend the playing surface when the auxiliary panels are disposed in the second orientation. In this case, the net can be adjusted to a first effective length to extend only across the playing surface when the auxiliary panels are in the first orientation and to a second effective length to extend across the playing surface and the auxiliary panels when the auxiliary panels are in the second orientation. Means connected to the net for maintaining the net at the first effective length and alternately at the second effective length.

The present invention is also directed to a method for modifying a table tennis table to provide alternative games, where the table tennis table includes a main panel defining a playing surface and having a pair of opposing edges and further includes a frame connected to the playing surface for supporting the playing surface in a horizontal orientation. The method utilizes a pair of auxiliary panels and comprises mounting the auxiliary panels to the frame along respective ones of the opposing edges. Thereafter, the auxiliary panels are moved relative to the main panel so that the auxiliary panels are connected to the main panel and have a first orientation extending substantially perpendicularly relative to the playing surface. Subsequently, the auxiliary panels are moved relative to the main panel so that the auxiliary panels are connected to the main panel and have a second orientation substantially coplanar with the playing surface to extend the playing surface.

In one embodiment of the present invention, the first orientation extends downwardly from the main panel, while the method more further comprises moving the auxiliary panels relative to the main panel so that the auxiliary panels are connected to the main panel and have a third orientation extending substantially perpendicularly relative to the main panel and upwardly from the main panel to form rebound surfaces.

In another method for modifying a table tennis table to provide alternative games, where the table tennis table includes a main panel defining a playing surface having a pair of opposing edges and further includes a frame connected to the main panel for supporting the main panel in a horizontal orientation, a pair of auxiliary panels are mounted to the frame along respective ones of the opposing edges so that the auxiliary panels extend in a substantially coplanar configuration with the playing surface to form an extended playing surface. The extended playing surface is provided with a net extending perpendicular upward from and transversely across a midline of the extended playing surface. Subsequently, the auxiliary panels are moved out of the coplanar configuration so that the main panel forms a conventional playing surface. The table having the conventional playing surface is provided with a shorter net extending perpendicular upwards and transversely along the midline across the conventional playing surface.

A table tennis table, conversion kit, and associated method according to the present invention allows a player to play a variety of table-tennis games.

It is to be noted that the doubles game envisioned by the present invention allows a different mode of play as compared to conventional doubles games. In conventional double table tennis, the two players on either end of the table alternate with one another in fielding shots. During a volley, no player is permitted to strike the ball two times in a row; the other player on the same team must strike the ball before the first player may hit the ball again. In contrast, with a broadened table tennis table in accordance with the present invention, a doubles table tennis game can be played in a manner similar to doubles play in tennis: either player on one side of the net can strike the ball, regardless of who played the ball the last time the ball was on that side of the net. Whether one player or the other on a team strikes the ball is determined by the locations of the players relative to the ball and the direction, velocity, etc., of the ball as it arrives from the other side of the net.

Accordingly, a method for playing a table tennis game in accordance with the present invention utilizes a table tennis table having a width exceeding a standard table tennis table width. The game is played with a first paddle, a second paddle, a third paddle, a fourth paddle, and a table tennis ball. The first paddle and the second paddle are held by a first player and a second player who are located as a team at one end of the table during the game, while the third paddle and the fourth paddle are held by a third player and a fourth player who are located as a team at an opposite end of the table during the game. The method includes striking the ball with the first paddle held by the first player located at the one end of the table. The ball is thus propelled from the one end of the table towards the opposite end of the table. As the ball arrives at the opposite end of the table, either the third paddle or the fourth paddle may be used (by the third player or the fourth player, respectively) to strike the ball to propel the ball from the opposite end of the table towards the one end of the table. As the ball arrives at the one end of the table, it is struck with either the first paddle (by the first player) or the second paddle (by the second player), in accordance with a direction of motion of the ball and the positions of the first player and the second player relative to the ball upon arrival of the ball at the one end of the table.

It is to be noted that a doubles table tennis table as described herein may have a fixed doubles width, i.e., may be built solely for doubles play.

DESCRIPTION OF THE PREFERRED EMBODIMENTS

Figure 1A:
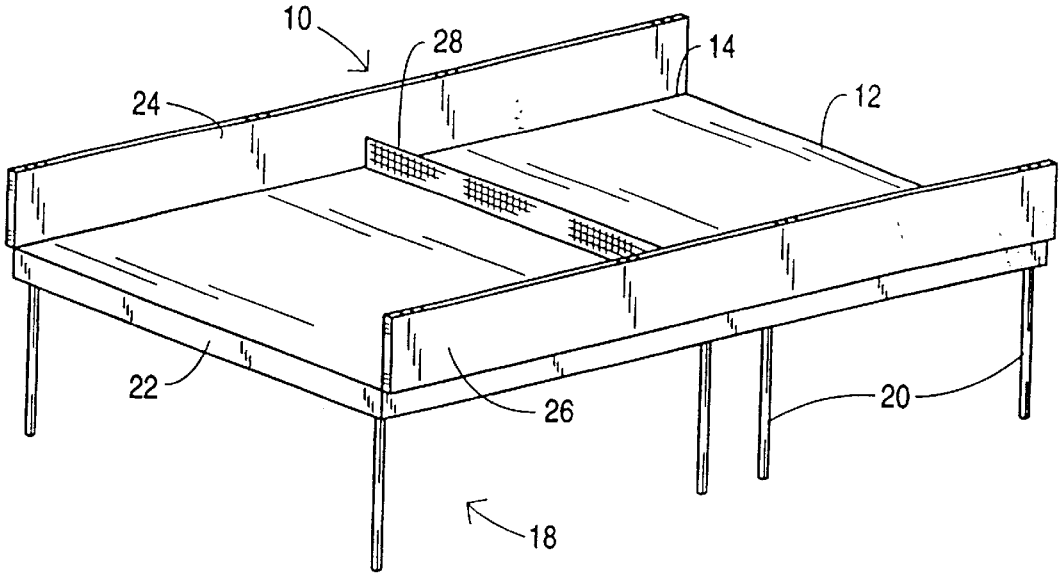
FIG. 1A is a schematic perspective view of a table tennis table with auxiliary panels in a vertical orientation.

A table tennis table 10 includes a main panel 12 forming the upper surface of table 10. Major edges 14 and 16 of main panel 12 extend along the length of the table. Main panel 12 is supported in a horizontal orientation by a frame 18. Frame 18 includes a plurality of legs 20 and may additionally include a skirt 22 depending downwardly from the edges of main panel 12, and particularly from major edges 14 and 16. A net 28 extends across the midline of the table and stands substantially perpendicularly with respect to main panel 12.

A pair of auxiliary panels 24 and 26 are mounted on table 10 along major edges 14 and 16, respectively, of main panel 12. Each auxiliary panel 24,26 has a length substantially equal to the main table length. The auxiliary panels cad be selectively positioned in different orientations. In a vertical orientation, as illustrated in FIG. 1A, the auxiliary panels 24,26 extend substantially perpendicularly upward relative to the main panel 12 to form rebound surfaces. With the auxiliary panels in the vertical orientation, players volleying a table tennis ball across the net have the option not only of bouncing the ball off of main panel 12, but also of rebounding the ball off auxiliary panels 24,26. Auxiliary panels 24,26 further serve to lessen the likelihood of the ball being struck off the side of table 10 and out of play, thus resulting in fewer interruptions than are encountered in a standard game of table tennis.

Figure 1B:
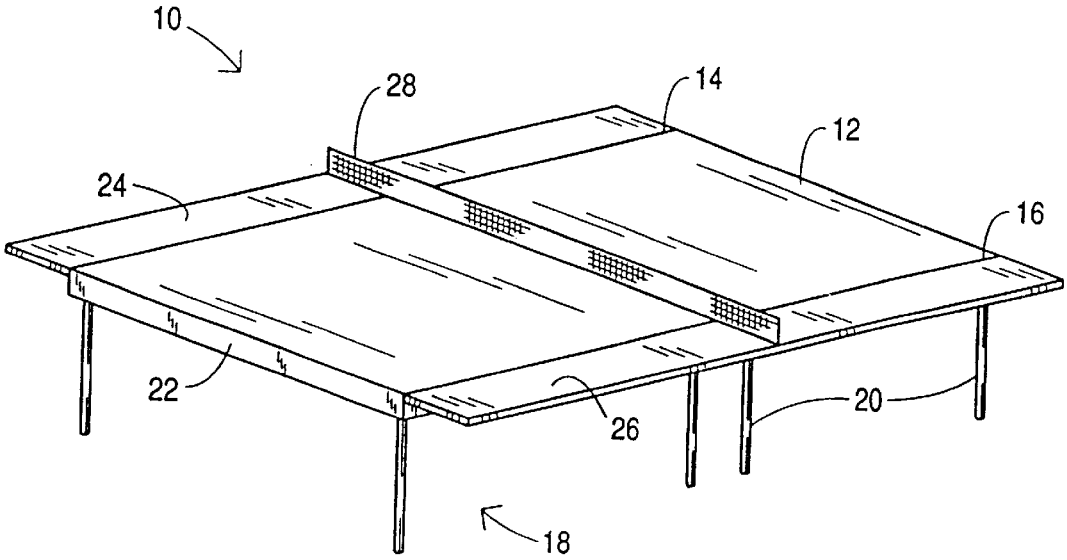
FIG. 1B is a schematic perspective view of a table tennis table with auxiliary panels in a horizontal orientation.

In a second, horizontal orientation, illustrated in FIG. 1B, auxiliary panels 24,26 are substantially coplanar with main panel 12, thus laterally extending a playing surface of the main panel. With the playing surface extended, it is possible to play at doubles, i.e., four people can play table tennis at once, with two players to a side.

Figure 1C:
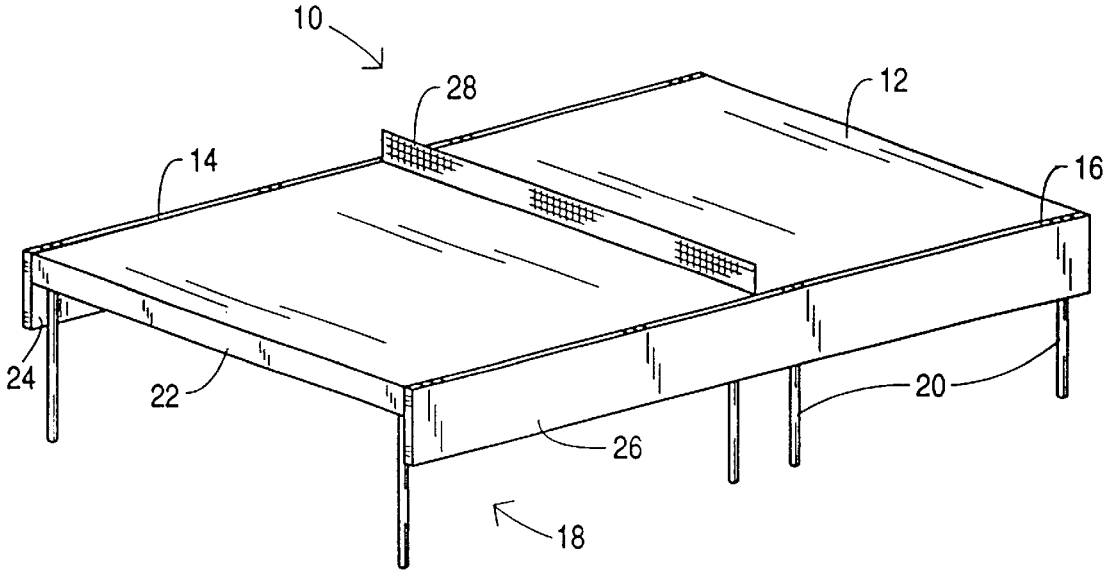
FIG. 1C is a schematic perspective view of a table tennis table with auxiliary panels in a storage orientation.

Naturally, it may not always be desirable to play table tennis with rebound surfaces or to play at doubles table tennis. In this case, auxiliary panels 24,26 can be positioned in a third, storage orientation, as illustrated in FIG. 1C. In the storage orientation, auxiliary panels 24,26 extend substantially perpendicularly downward relative to main panel 12. In the storage orientation, auxiliary panels 24,26 do not interfere with standard table tennis play. However, the auxiliary panels are readily at hand should it be desired to move them into position for doubles play or for use as rebound surfaces.

Figure 2:
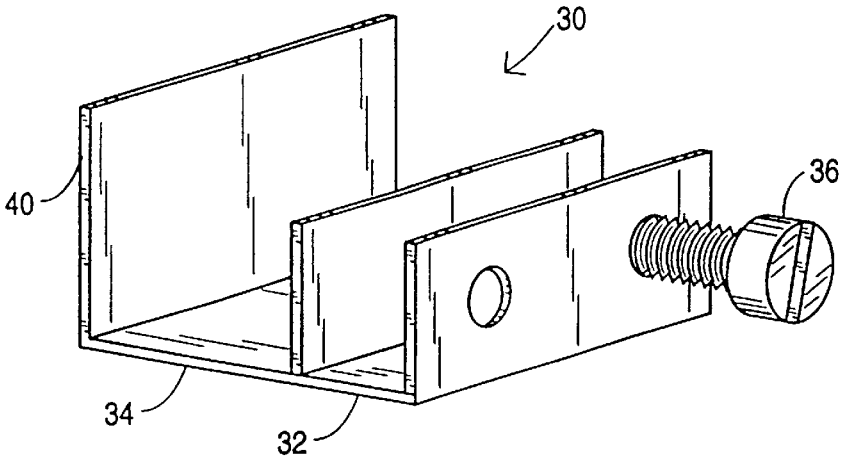
FIG. 2 is a schematic perspective view of a mounting bracket for use in the present invention.
Figure 3A:
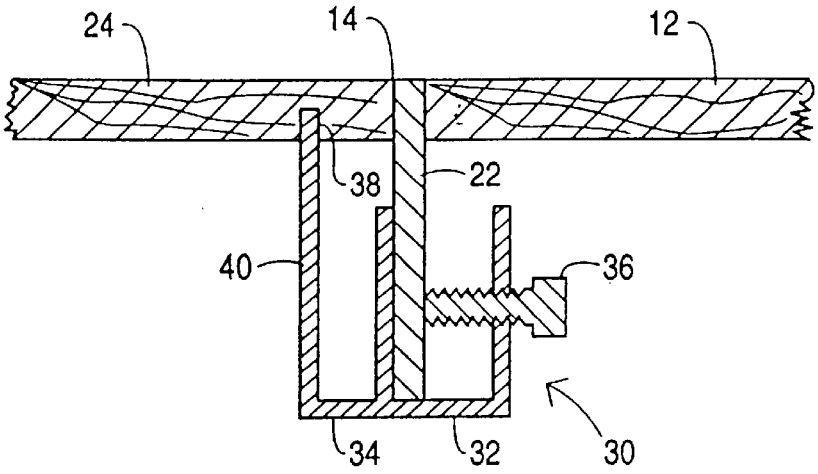
FIG. 3A is a cross-sectional view of an auxiliary panel mounted in the horizontal orientation with the mounting bracket.
Figure 3B:
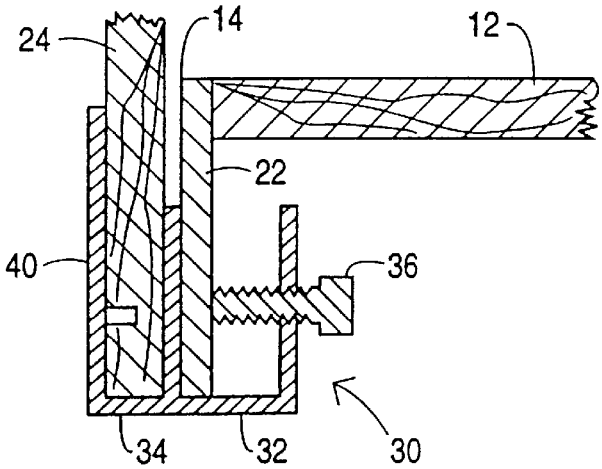
FIG. 3B is a cross-sectional view of an auxiliary panel mounted in the vertical orientation with the mounting bracket.

Auxiliary panels 24,26 are mounted either directly on frame 18 or indirectly on frame 18, e.g. by mounting auxiliary panels 24,26 to main panel 12, which is itself mounted on frame 18. One element for mounting auxiliary panels to frame 18 is illustrated in FIG. 2. A mounting bracket 30 includes a U-shaped portion 32 and an L-shaped portion 34 with vertical extension 40. U-shaped portion 32 is sized to accept a bottom edge of skirt 22, as illustrated in FIGS. 3A–B. A bolt 36, or other tightening componentry, is provided in U-shaped portion 32 to grip skirt 22. A plurality of notches 38 are provided along auxiliary panels 24,26. Each notch 38 accepts the upper end of vertical portion 40 of a bracket 30 when an auxiliary panel is mounted in the horizontal orientation (FIG. 3A). It is contemplated that a plurality of brackets 30 will be disposed along major edges 14 and 16. Of course, notch 38 may be a single groove which extends along most or all of the length of auxiliary panel 24.

Brackets 30 further serve to support auxiliary panels 24,26 in a vertical configuration, as illustrated in FIG. 3B. Auxiliary panel 24 is slid into L-shaped portion 34 of bracket 30 and held vertically between vertical portion 40 and skirt 22.

Because standard table tennis tables frequently have a skirt 22, auxiliary panels 24,26 and brackets 30 can be provided as parts of a kit used to modify or retrofit a standard table tennis table to accommodate alternative games, such as table tennis with side rebound walls and doubles table tennis.

Figure 4A:
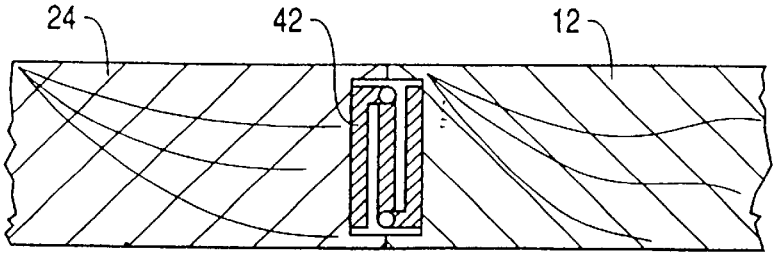
FIG. 4A is a cross-sectional view of an auxiliary panel mounted with a double acting hinge in the horizontal orientation.

Another element useful for mounting auxiliary panels 24,26 indirectly on frame 18 is a double acting hinge 42 mounted between auxiliary panels 24,26 and main panel 12. As illustrated in FIGS. 4A, B, and C, double acting hinge 42 holds auxiliary panel 24 in the horizontal, vertical, and storage positions, respectively, while maintaining the play surface free of gaps or ridges which could interfere with the direction of a rebounded ball. Preferably, a plurality of double acting hinges 42 are mounted along major edges 14 and 16.

A variety of mounting elements will be apparent to one skilled in the art. For example, auxiliary panels 24,26 may be provided with two perpendicular sets of bores, and the panels can be mounted to the frame using bolts or pins which extend into one of the sets of bores. One set of bores is used to mount the panel in the horizontal orientation, and the other set is used to mount the panel in the vertical orientation.

Figure 5A:
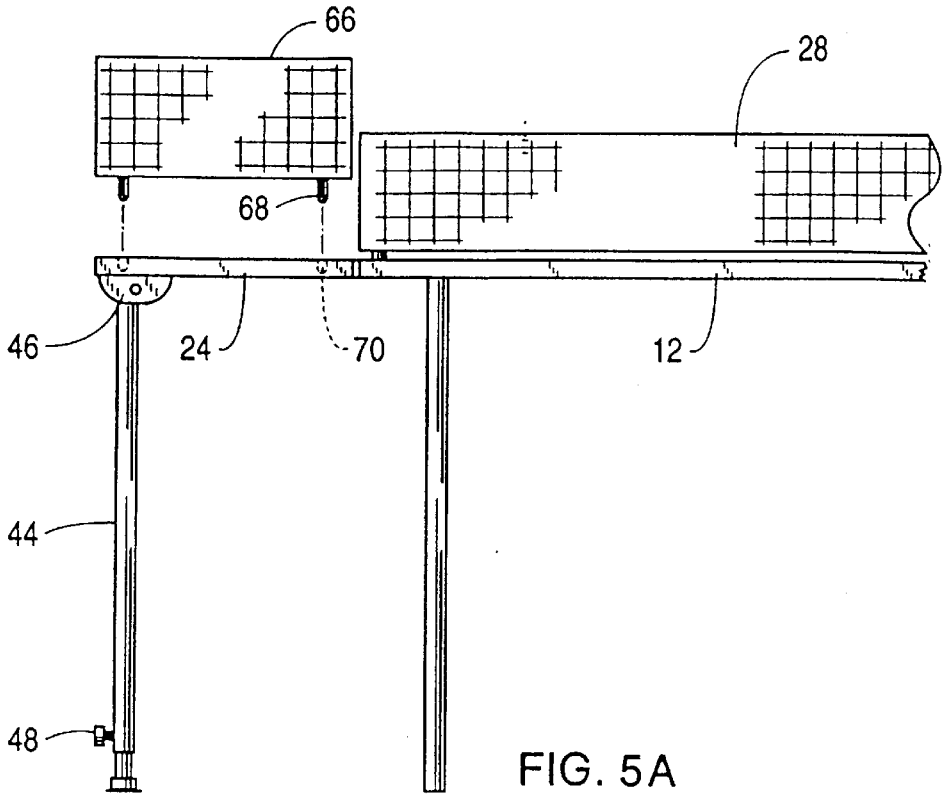
FIG. 5A is a side view of an auxiliary panel supported in the horizontal orientation with extendible legs.
Figure 5B:
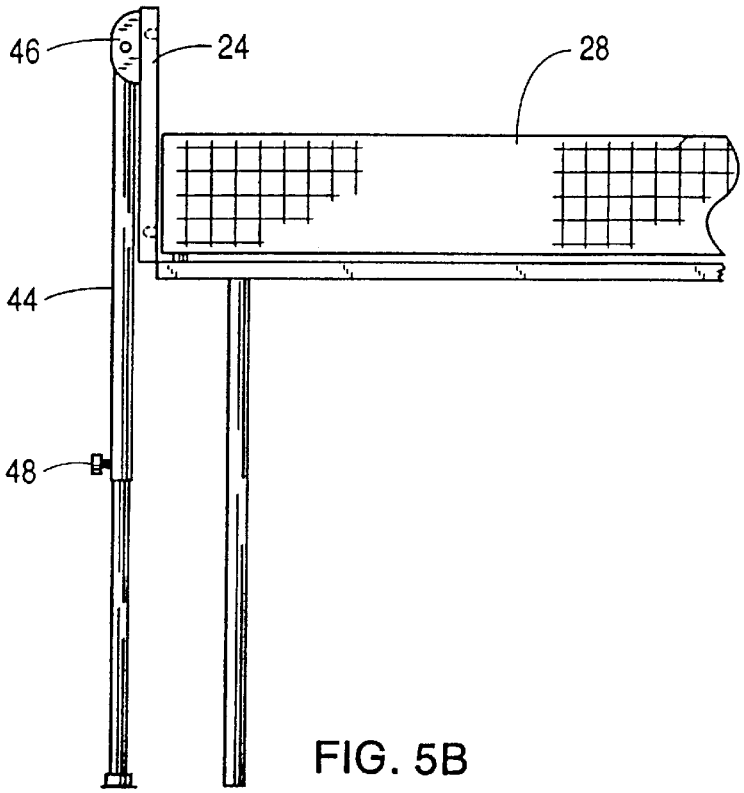
FIG. 5B is a side view of an auxiliary panel supported in the vertical orientation with extendible legs.

In order to hold auxiliary panels 24,26 imposition, whether in the horizontal or vertical orientation, a bracing element is supplied to aid in supporting auxiliary panels 24, 26. As illustrated in FIGS. 5A–B, leg 44 is mounted on auxiliary panel 24 at pivot 46. The length of leg 44 is adjustable in a telescopic fashion and can be held in one of two selected effective lengths with a latch 48. In the shorter of the effective lengths, illustrated in FIG. 5A, leg 44 supports panel 24 in the horizontal position. In the longer of the effective lengths, illustrated in FIG. 5B, leg 44 supports panel 24 in the vertical rebound position. Preferably, at least two legs 44 are provided on each one of auxiliary panels 24,26.

Figure 7:
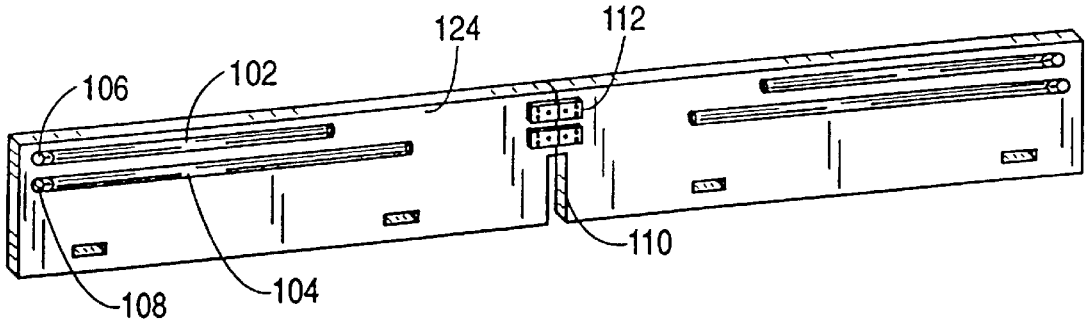
FIG. 7 is a schematic perspective view of an alternative auxiliary panel.

As illustrated in FIG. 7, it is contemplated that as an alternative to legs with adjustable lengths, multiple legs with different lengths may be mounted on an auxiliary panel 124. Short leg 102 is mounted via a pivot 106 to panel 124, and long leg 104 is mounted to panel 124 via another pivot 108. Long leg 104 is extended to support panel 124 in the vertical rebound position, and short leg 102 is extended to support panel 124 in the horizontal position.

Figure 6A:
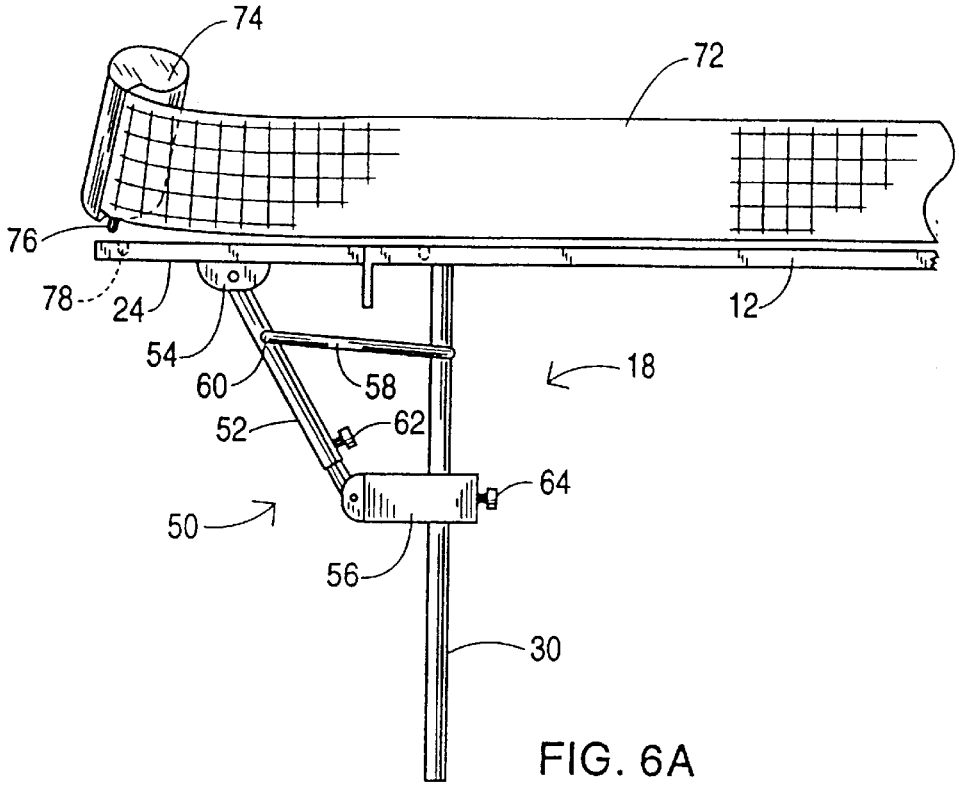
FIG. 6A is a side view of an auxiliary panel supported in the horizontal orientation with a slidable linkage.
Figure 6B:
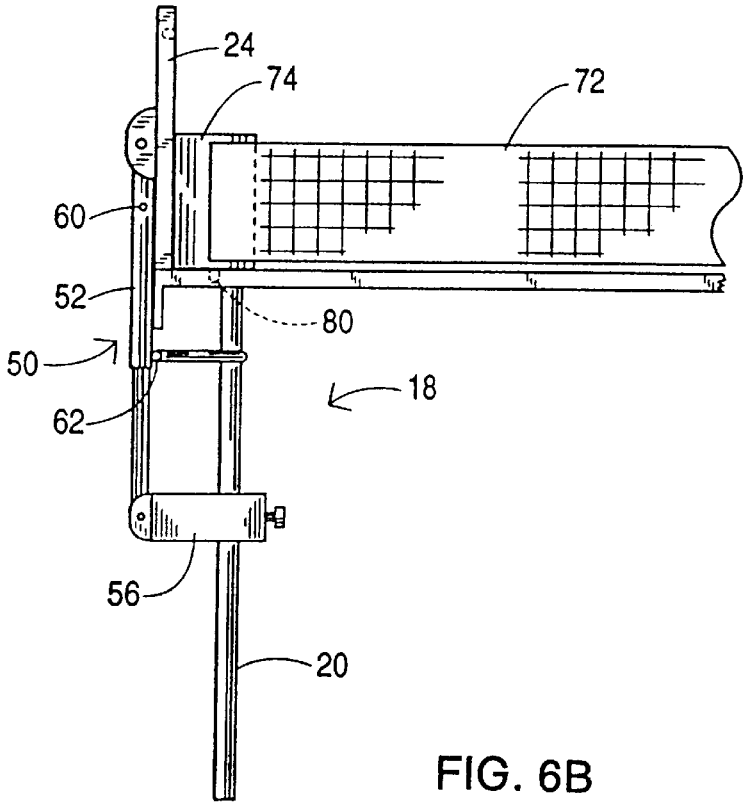
FIG. 6B is a side view of an auxiliary panel supported in the vertical orientation with a slidable linkage.

An alternative brace in the form of a slidable linkage 50 is illustrated in FIGS. 6A–B. Slidable linkage 50 includes telescoping strut 52 which is adjustable between two different lengths. Telescoping strut 52 is attached at one end to auxiliary panel 24 via pivot 54 and at the other end to frame 18 via pivoted bracket 56. Pivoted bracket 56 is attached to a leg 20 of frame 18 and held in position with a latch 64. A tension cord 58, such as a bungee cord, a rubber band, or a spring, attaches to telescoping strut 52 alternatively at an upper link 60 or a lower link 62. Tension cord 58 extends around leg 20 to aid in bracing auxiliary panel 24 by drawing telescoping strut 52 toward the frame.

Various additional braces will be apparent to one of ordinary skill in the art. For example, any of various multi-jointed connectors, such as locking snake connectors or double-joint arm connectors may be used to brace the auxiliary panels. One end of the multi-jointed connector is attached at least indirectly (i.e., directly or indirectly) to the frame, while another end is connected to the auxiliary panel. Preferably, at least two such connectors would be used for each auxiliary panel. Where the brace supplies sufficient support to the auxiliary panel without the use of a mounting element such as a bracket 30 or hinge 42, i.e. where the auxiliary panel is not displaced from a selected orientation during the course of ordinary play, the mounting element may be eliminated. Similarly, where the mounting element supplies sufficient support to the auxiliary panel without the aid of a bracket, the brackets may be eliminated.

When the auxiliary panels 24 are disposed in the horizontal orientation for doubles play, it is desirable to provide a net which extends all the way across the midline of the playing surface. As illustrated in FIG. 5A, with auxiliary panel 24 in the horizontal orientation, a net extension segment 66 with support pegs 68 is insertable in complementary recesses 70 of panel 24. As illustrated in FIG. 6A–B, an adjustable-length net 72 is dispensed from a net roll 74. Net roll 74 may be tensioned in the manner of an automatic tape measure to be biased to pull net 72 into net roll 74. Net roll 74 is provided with pegs 76 on a lower surface thereof. Pegs 76 fit alternatively into recess 78 on auxiliary panel 24 and recess 80 on main panel 12. For rebound play with auxiliary panel 24 in the vertical position, pegs 76 are fit into recess 80, while for doubles play with auxiliary panel 24 in the horizontal position, net 72 is pulled from net roll 74 to increase the length of net 72, and pegs 76 are fit into recess 78. Of course, various alternative configurations are available to adjust the length of the net, including simply providing two different nets with differing lengths, and replacing the shorter net with the longer net for doubles play.

In many existing table tennis tables, the net extends somewhat beyond the playing surface. In that case, when using an auxiliary panel in the vertical orientation as a rebound surface, it may be desirable to employ a panel 124 having a central notch 110 (FIG. 7). Notch 110 fits over the existing net and allows rebound play without changing the net. As an additional option, auxiliary panel 124 may be hinged with hinges 112 to allow panel 124 to be folded in half for less cumbersome storage and transport.

As mentioned above, a table tennis table can be modified to accommodate alternative games with the use of a kit including a pair of auxiliary panels such as panels 24, 26, a mounting element such as brackets 30, braces such as legs 44, slidable linkages 50 or legs 102 and 104, and a net with variable length, such as net 72 or net 28 together with net extensions 66. In addition, such a kit may include a carrying case for all of the above items.

Figure 4B:
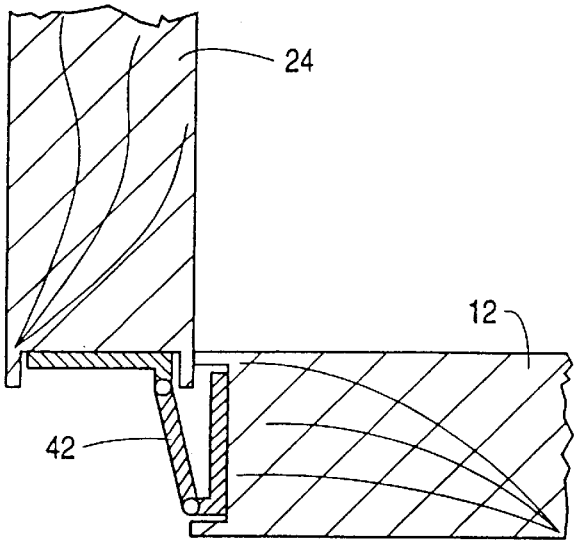
FIG. 4B is a cross-sectional view of an auxiliary panel mounted with a double acting hinge in the vertical orientation.
Figure 4C:
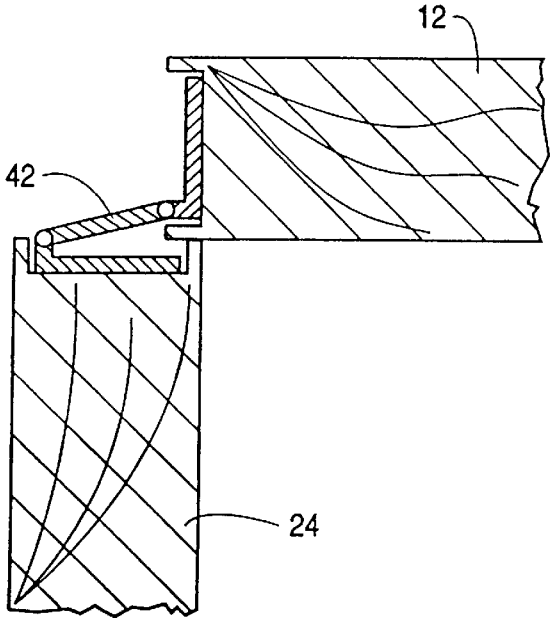
FIG. 4C is a cross-sectional view of an auxiliary panel mounted with a double acting hinge in the storage orientation.
Figure 8A:
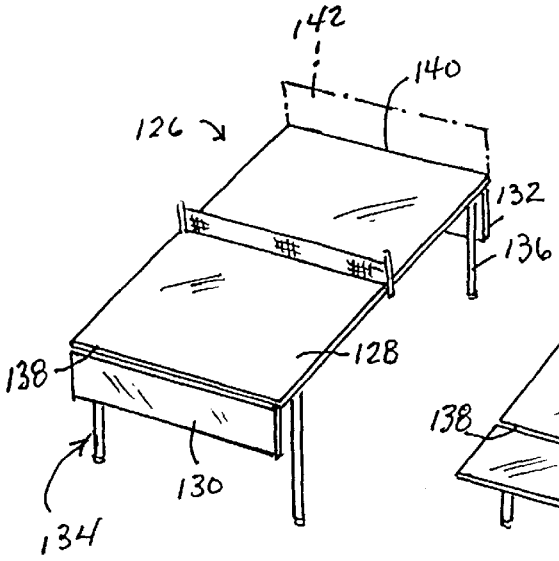
FIG. 8A is a schematic perspective view of another table tennis table in accordance with the present invention, showing table end flaps in a downwardly oriented, non-use position.
Figure 8B:
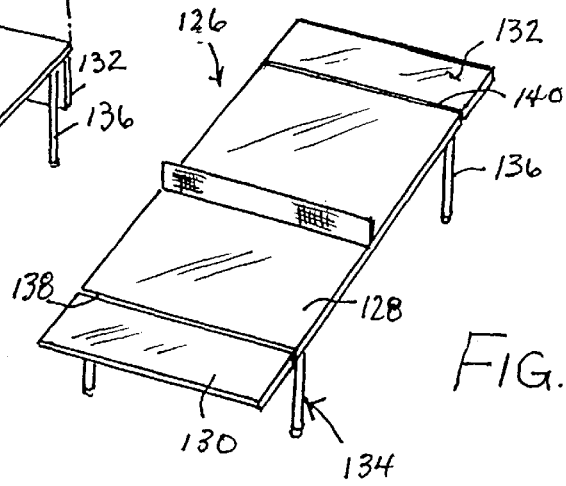
FIG. 8B is a schematic perspective view of the table of FIG. 8A, showing the end flaps in a raised, horizontal position.

As illustrated in FIGS. 8A and 8B, a table tennis table 126 having a main panel 128 defining a playing surface (not separately designated) may be provided with a pair of auxiliary panels 130 and 132 at the ends of the main panel. In a non-use configuration (FIG. 8A), auxiliary panels 130 and 132 extend downwardly from main panel. Auxiliary panels 130 and 132 may be moved from the downward orientation to a horizontal orientation (FIG. 8B) for purposes of longitudinally extending the playing surface of main panel 128. To enable auxiliary panels 130 and 132 to assume the alternate configurations of FIGS. 8A and 8B, adjustable mounting elements are provided for mounting the auxiliary panels to a frame 134 which includes legs 136. More specifically, auxiliary panels 130 and 132 are mounted to main panel 128 along respective end edges 138 and 140 thereof. The mounting elements connecting auxiliary panels 130 and 132 to main panel 128 may be the same as double acting hinge 42 (FIGS. 4A–4C), or telescoping legs 44 (FIGS. 5A and 5B), or linkage 50 (FIGS. 6A and 6B). These mounting elements enable auxiliary panels 130 and 132 to additionally assume an upwardly extending position 142 (FIG. 8A) perpendicular to main panel 128 and the playing surface thereof. This upwardly extending position may be used for practice.

Of course, where the upwardly extending practice position 142 is not desired, the mounting elements connecting auxiliary panels 130 and 132 to main panel 128 may be simplified. For example, instead of double hinge 42, a conventional single hinge, with a single axis of rotation, could be used. Instead of telescoping legs 44, a pair of single-length legs (compare FIG. 7) may be pivotably attached to the underside of each auxiliary panel 130 and 132 for supporting the auxiliary panels in the extended horizontal orientation of FIG. 8B.

Figure 9A:
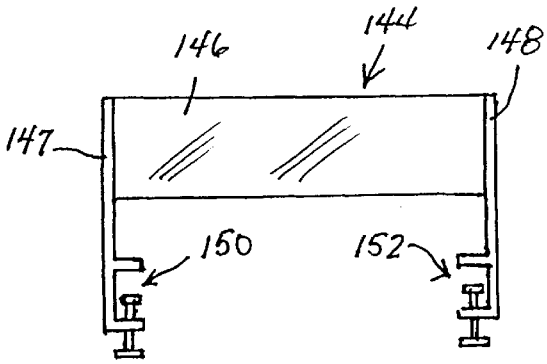
FIG. 9A is a schematic front elevational view of an add-on practice board for a table tennis table, in accordance with the present invention.
Figure 9B:
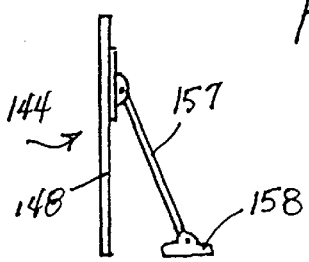
FIG. 9B is a schematic side elevational view of the board of FIG. 9A.
Figure 11:
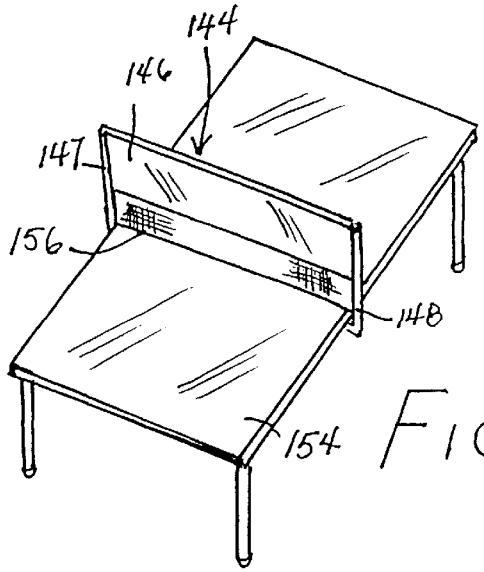
FIG. 11 is a schematic perspective view of a table tennis table with the practice board of FIGS. 9A and 9B installed over a table tennis net.

As depicted in FIGS. 9A, 9B and 11, a practice stop or rebound member 144 is provided by a plate or board 146 attached along opposite sides to a pair of braces or struts 147 and 148. At their lower ends, braces or struts 147 and 148 are provided with C-clamps 150 and 152 for removably attaching the practice stop or rebound member 144 to a table tennis table 154, as illustrated in FIG. 11. Plate or board 146 is disposed above a net 156 of table 154, for returning to a practicing player a table tennis ball impelled against the plate or board. A lean or brace 157 may be provided on a rear side of rebound member 144 and is pivotably attached at one end to plate or board 146 and at an opposite end to a foot 158 with a high friction underside disposable in contact with the playing surface of table 154.

Figure 10:
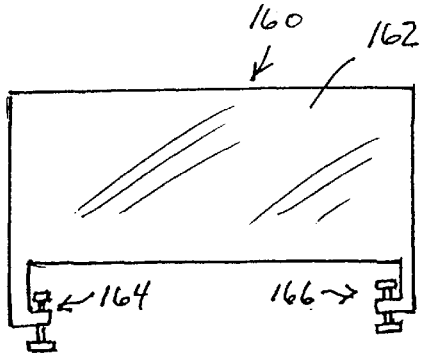
FIG. 10 is a schematic front elevational view of another add-on practice board for a table tennis table, in accordance with the present invention.

As illustrated in FIG. 10, a modified rebound member 160 includes a plate or board 162 which is wider than plate or board 146 and rests on the playing surface of table tennis table 154. Thus, upon installation of rebound member 160 on table 154, plate or board 162 overlaps net 156 and extends thereabove. Rebound member 160 is provided with C-clamps 164 and 166 for removably securing the rebound member to table 154 adjacent to net 156.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A table tennis table comprising:

a main panel defining a playing surface and having a pair of opposing edges;

a frame connected to said playing surface for supporting said playing surface in a horizontal orientation;

a pair of substantially rigid auxiliary panels;

adjustable mounting elements mounting said auxiliary panels to said frame along respective ones of said edges so that said auxiliary panels each have a first orientation extending substantially perpendicularly relative to said main panel and an alternate second orientation substantially coplanar with said main panel to extend said playing surface of said main panel; and a table tennis net connected perpendicular to said playing surface and extending transversely along a midline thereof.

2. The table tennis table defined in claim 1 wherein said edges are major edges of said main panel and extend parallel to a length dimension of said main panel, said auxiliary panels serving to laterally extend said playing surface when said auxiliary panels are disposed in said second orientation.

3. The table tennis table defined in claim 2 wherein said net can be adjusted to a first effective length to extend only across said playing surface when said auxiliary panels are in said first orientation and to a second effective length to extend across said playing surface and said auxiliary panels when said auxiliary panels are in said second orientation.

4. The table tennis table defined in claim 3, further comprising means connected to said net for maintaining said net at said first effective length and alternately at said second effective length.

5. The table tennis table defined in claim 1 wherein said auxiliary panels extend downwardly from said main panel in said first orientation and wherein said adjustable mounting elements include means for mounting said auxiliary panels to said frame along respective ones of said edges so that said auxiliary panels have a third orientation extending substantially perpendicularly relative to said main panel and upwardly from said main panel.

6. The table tennis table defined in claim 5, further comprising a bracket connected to said frame for attaching said auxiliary panels alternately in said second orientation and said third orientation.

7. The table tennis table defined in claim 6 wherein said bracket includes a pair of legs of different effective lengths, one length for supporting said auxiliary panels in said second orientation and another length in combination with said one length for supporting said auxiliary panels in said third orientation.

8. The table tennis table defined in claim 7 wherein said legs include legs having said one length and different legs having said another length, said legs being pivotally coupled to said auxiliary panels.

9. The table tennis table defined in claim 1 wherein said adjustable mounting elements include a plurality of brackets each connected at one end thereof to said frame and at an opposite end thereof to one of said auxiliary panels.

10. The table tennis table defined in claim 9 wherein said brackets each take the form of a slidable linkage.

11. The table tennis table defined in claim 10 wherein said adjustable mounting elements further include tension cords each extending between said frame and said linkage for drawing said linkage toward said frame.

12. The table tennis table defined in claim 1 wherein said playing surface is provided with a downwardly depending skirt, said adjustable mounting elements including a plurality of brackets removably connected to said skirt, said adjustable mounting elements further including means on said auxiliary panels for cooperating with said brackets to support said auxiliary panels on said brackets.

13. The table tennis table defined in claim 12 wherein said brackets each include an L-shaped portion, said means for cooperating being notches.

14. The table tennis table defined in claim 1 wherein said adjustable mounting elements include a plurality of double acting hinges each connected to said main panel and one of said auxiliary panels.

15. The table tennis table defined in claim 1 wherein said edges are minor or shorter edges of said main panel and extend parallel to a width dimension of said main panel, said auxiliary panels serving to longitudinally extend said playing surface when said auxiliary panels are disposed in said second orientation.

16. A kit for modifying a table tennis table including a main panel defining a playing surface and having a pair of opposing edges, said table further including a frame connected to said playing surface for supporting said playing surface in a horizontal orientation, said kit comprising:

a pair of substantially rigid auxiliary panels;

adjustable mounting elements for attaching said auxiliary panels to said frame along respective ones of said edges so that said auxiliary panels have a first orientation extending substantially perpendicular to and downwardly from said playing surface and an alternate second orientation substantially coplanar with said playing surface to extend said playing surface; and a net connectable perpendicular to said playing surface and extending transversely along a midline thereof.

17. The kit defined in claim 16 wherein said edges are major edges of said main panel and extend parallel to a length dimension of said main panel, said auxiliary panels serving to laterally extend said playing surface when said auxiliary panels are disposed in said second orientation.

18. The kit defined in claim 17 wherein said net can be adjusted to a first effective length to extend only across said playing surface when said auxiliary panels are in said first orientation and to a second effective length to extend across said playing surface and said auxiliary panels when said auxiliary panels are it said second orientation.

19. The kit defined in claim 18, further comprising means connected to said net for maintaining said net at said first effective length and alternately at said second effective length.

20. The kit defined in claim 16 said auxiliary panels extend downwardly from said main panel in said first orientation and wherein said adjustable mounting elements include means for mounting said auxiliary panels to said frame along respective ones of said edges so that said auxiliary panels have a third orientation extending substantially perpendicularly relative to said main panel and upwardly from said main panel.

21. The kit defined in claim 20, further comprising upright supports connectable to said auxiliary panels for supporting said auxiliary panels alternately in said second orientation and said third orientation.

22. The kit defined in claim 21 wherein said upright supports include legs on said auxiliary panels, said legs having two effective lengths, one length for supporting said auxiliary panels in said second orientation and another length for supporting said auxiliary panels in said third orientation.

23. The kit defined in claim 16 wherein said adjustable mounting elements include a plurality of brackets each connected at one end thereof to said frame and at an opposite end thereof to one of said auxiliary panels.

24. The kit defined in claim 23 wherein said brackets each take the form of a slidable linkage.

25. The kit defined in claim 24 wherein said adjustable mounting elements further include tension cords each connectable to said frame and one said linkage for drawing same toward said frame.

26. The kit defined in claim 16 wherein said main panel is provided with a downwardly depending skirt, said adjustable mounting elements including a plurality of brackets removably connectable to said skirt, said adjustable mounting elements further including means on said auxiliary panels for cooperating with said brackets to support said auxiliary panels on said brackets.

27. The kit defined in claim 26 wherein said brackets each include an L-shaped formation, said means for cooperating defining apertures receiving said L-shaped formation.

28. The kit defined in claim 16 wherein said edges are minor or shorter edges of said main panel and extend parallel to a width dimension of said main panel, said auxiliary panels serving to longitudinally extend said playing surface when said auxiliary panels are disposed in said second orientation.

29. A method for modifying a table tennis table to provide alternative games, said table tennis table including a main panel defining a playing surface and having a pair of opposing edges, said table further including a frame connected to said playing surface for supporting said playing surface in a horizontal orientation, said method comprising:

providing a pair of auxiliary panels;

mounting said auxiliary panels to said frame along respective ones of said opposing edges;

after mounting said auxiliary panels to said frame along said opposing edges, moving said auxiliary panels relative to said main panel so that said auxiliary panels are connected to said main panel and have a first orientation extending substantially perpendicularly relative to said playing surface; and subsequently moving said auxiliary panels relative to said main panel so that said auxiliary panels are connected to said main panel and have a second orientation substantially coplanar with said playing surface to extend said playing surface.

30. The method defined in claim 29 wherein said first orientation extends downwardly from said main panel, further comprising moving said auxiliary panels relative to said main panel so that said auxiliary panels are connected to said main panel and have a third orientation extending substantially perpendicularly relative to said main panel and upwardly from said main panel to form rebound surfaces.

31. A method for modifying a table tennis table to provide alternative games, said table tennis table including a main panel defining a playing surface having a pair of opposing edges, said table further including a frame connected to said main panel for supporting said main panel in a horizontal orientation, said method comprising:

providing a pair of auxiliary panels;

mounting said auxiliary panels to said frame along respective ones of said opposing edges so that said auxiliary panels extend in a substantially coplanar configuration with said playing surface to form an extended playing surface;

providing the extended playing surface with a net extending perpendicular upward from and transversely across a midline of said extended playing surface;

subsequently moving said auxiliary panels out of said coplanar configuration so that said main panel forms a conventional playing surface; and providing the table having the conventional playing surface with a shorter net extending perpendicular upwards and transversely along the mid-line across the conventional playing surface.

32. The method defined in claim 31 wherein the moving of said auxiliary panels includes shifting said panels to be substantially perpendicular relative to said playing surface.

33. A method for using a table tennis table, comprising:

attaching a plate or board to a table tennis table approximately along a midline thereof so that at least a portion of said board extends above a table tennis net extending along said midline;

after attaching of said plate or board to said table, hitting a ball against said plate or board so that the ball rebounds from said plate or board; and hitting the rebounding ball again against said plate or board.

* * * * *